US010818251B2

(12) United States Patent
Chen

(10) Patent No.: US 10,818,251 B2
(45) Date of Patent: Oct. 27, 2020

(54) DISPLAY DEVICE AND METHOD AND DEVICE OF DRIVING THE DISPLAY DEVICE

(71) Applicants: HKC Corporation Limited, Shuitian Village, Shiyan Sub-Dist., Baoan Dist., Shenzhen, Guangdong (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/465,955

(22) PCT Filed: Sep. 1, 2017

(86) PCT No.: PCT/CN2017/100248
§ 371 (c)(1),
(2) Date: May 31, 2019

(87) PCT Pub. No.: WO2018/113342
PCT Pub. Date: Jun. 28, 2018

(65) Prior Publication Data

US 2019/0311687 A1 Oct. 10, 2019

(30) Foreign Application Priority Data

Dec. 23, 2016 (CN) ..... 2016 1 1215170

(51) Int. Cl.
*G09G 3/36* (2006.01)

(52) U.S. Cl.
CPC ..... *G09G 3/3607* (2013.01); *G09G 3/3611* (2013.01); *G09G 2320/0242* (2013.01); *G09G 2360/16* (2013.01)

(58) Field of Classification Search
CPC ..... G09G 3/3607; G09G 3/3611; G09G 2320/0242; G09G 2360/16
See application file for complete search history.

(56) References Cited

U.S. PATENT DOCUMENTS

2014/0160174 A1 6/2014 Tsuei et al.
2017/0018219 A1* 1/2017 Wang ..... G09G 3/2092

FOREIGN PATENT DOCUMENTS

CN 1870122 A 11/2006
CN 101009083 A 8/2007
(Continued)

*Primary Examiner* — Wing H Chow
(74) *Attorney, Agent, or Firm* — Muncy, Geissler, Olds & Lowe, P.C.

(57) ABSTRACT

A display device and a method and device of driving a display device are provided. The method includes: dividing sub-pixels of a display panel into a plurality of array blocks, and selecting at least one of the sub-pixels in the blocks as a luminous pixel; receiving a to-be-displayed image, acquiring a pixel signal of a pixel of the display panel, obtaining the pixel signal from a look-up table, and obtaining first driving signals of the sub-pixels of each of the pixels; calculating a first brightness signal of driving the luminous pixel in the array block according to the first driving signals of the sub-pixels in the same array blocks; and using the first brightness signal to drive the luminous pixel, and using the pixel signal to drive other ones of the sub-pixels.

12 Claims, 11 Drawing Sheets

| | | | | | | | | |
|---|---|---|---|---|---|---|---|---|
| 0.4 | 0.8 | 0.4 | 0.4 | 0.8 | 0.4 | 0.4 | 0.8 | 0.4 |
| 0.8 | 1 | 0.8 | 0.8 | 1 | 0.8 | 0.8 | 1 | 0.8 |
| 0.4 | 0.8 | 0.4 | 0.4 | 0.8 | 0.4 | 0.4 | 0.8 | 0.4 |
| 0.4 | 0.8 | 0.4 | 0.4 | 0.8 | 0.4 | 0.4 | 0.8 | 0.4 |
| 0.8 | 1 | 0.8 | 0.8 | 1 | 0.8 | 0.8 | 1 | 0.8 |
| 0.4 | 0.8 | 0.4 | 0.4 | 0.8 | 0.4 | 0.4 | 0.8 | 0.4 |
| 0.4 | 0.8 | 0.4 | 0.4 | 0.8 | 0.4 | 0.4 | 0.8 | 0.4 |
| 0.8 | 1 | 0.8 | 0.8 | 1 | 0.8 | 0.8 | 1 | 0.8 |
| 0.4 | 0.8 | 0.4 | 0.4 | 0.8 | 0.4 | 0.4 | 0.8 | 0.4 |

(56) References Cited

FOREIGN PATENT DOCUMENTS

| | | | |
|---|---|---|---|
| CN | 103137075 | A | 6/2013 |
| CN | 104900205 | A | 9/2015 |
| CN | 106531102 | A | 3/2017 |

* cited by examiner

| | | | | | | | | |
|---|---|---|---|---|---|---|---|---|
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |

FIG.2

| | | | | | | | | |
|---|---|---|---|---|---|---|---|---|
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |

FIG.3

| | | | | | | | | |
|---|---|---|---|---|---|---|---|---|
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |

FIG.4

| | | | | | | | | |
|---|---|---|---|---|---|---|---|---|
| L | R | L | R | L | R | L | R | L |
| R | L | R | L | R | L | R | L | R |
| L | R | L | R | L | R | L | R | L |
| R | L | R | L | R | L | R | L | R |
| L | R | L | R | L | R | L | R | L |
| R | L | R | L | R | L | R | L | R |
| L | R | L | R | L | R | L | R | L |
| R | L | R | L | R | L | R | L | R |
| L | R | L | R | L | R | L | R | L |

FIG.5

| | | | | | | | | |
|---|---|---|---|---|---|---|---|---|
| R | R | R | R | R | R | R | R | R |
| R | L | R | L | R | L | R | L | R |
| R | R | R | R | R | R | R | R | R |
| R | L | R | L | R | L | R | L | R |
| R | R | R | R | R | R | R | R | R |
| R | L | R | L | R | L | R | L | R |
| R | R | R | R | R | R | R | R | R |
| R | L | R | L | R | L | R | L | R |
| R | R | R | R | R | R | R | R | R |

FIG.6

| | | | | | | | | |
|---|---|---|---|---|---|---|---|---|
| R | R | R | R | R | R | R | R | R |
| R | L | R | R | L | R | R | L | R |
| R | R | R | R | R | R | R | R | R |
| R | R | R | R | R | R | R | R | R |
| R | L | R | R | L | R | R | L | R |
| R | R | R | R | R | R | R | R | R |
| R | R | R | R | R | R | R | R | R |
| R | L | R | R | L | R | R | L | R |
| R | R | R | R | R | R | R | R | R |

FIG.7

| | | | | | | | | |
|---|---|---|---|---|---|---|---|---|
| L1 | L2 | L3 | L | L | L | L | L | L |
| L4 | L5 | L6 | L | L | L | L | L | L |
| L7 | L8 | L9 | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |

FIG.8

| | | | | | | | | |
|---|---|---|---|---|---|---|---|---|
| 0.4 | 0.8 | 0.4 | 0.4 | 0.8 | 0.4 | 0.4 | 0.8 | 0.4 |
| 0.8 | 1 | 0.8 | 0.8 | 1 | 0.8 | 0.8 | 1 | 0.8 |
| 0.4 | 0.8 | 0.4 | 0.4 | 0.8 | 0.4 | 0.4 | 0.8 | 0.4 |
| 0.4 | 0.8 | 0.4 | 0.4 | 0.8 | 0.4 | 0.4 | 0.8 | 0.4 |
| 0.8 | 1 | 0.8 | 0.8 | 1 | 0.8 | 0.8 | 1 | 0.8 |
| 0.4 | 0.8 | 0.4 | 0.4 | 0.8 | 0.4 | 0.4 | 0.8 | 0.4 |
| 0.4 | 0.8 | 0.4 | 0.4 | 0.8 | 0.4 | 0.4 | 0.8 | 0.4 |
| 0.8 | 1 | 0.8 | 0.8 | 1 | 0.8 | 0.8 | 1 | 0.8 |
| 0.4 | 0.8 | 0.4 | 0.4 | 0.8 | 0.4 | 0.4 | 0.8 | 0.4 |

FIG.9

DISPLAY DEVICE AND METHOD AND DEVICE OF DRIVING THE DISPLAY DEVICE

BACKGROUND

Technical Field

This disclosure relates to a technical field of a panel display, and more particularly relates to a method and a device of driving a display device, and a display device using the driving method.

Related Art

Most of the existing large-size LCD display panels use negative type vertical alignment (VA) liquid crystal or in-plane switching (IPS) liquid crystal technology. Compared with the IPS liquid crystal technology, the VA-type liquid crystal technology has advantages of high production efficiency and low manufacturing cost, but has more obvious defects in the optical properties. More particularly, the large-size panels in the commercial applications need a larger viewing angle presentation, the VA-type liquid crystal driving often cannot satisfy the market application requirements in the viewing angle color shift, and this affects the popularization of the VA-type liquid crystal technology.

In general, the VA-type liquid crystal technology solves the viewing angle color shift by the method of dividing each primary color of the RGB (Red, Green, Blue) into primary and secondary pixels, and applying different driving voltages to the primary and secondary pixels in the space to solve the defect of the viewing angle color shift. Such pixel design often needs to again design the metal layout or thin film transistor element to drive the secondary pixel, and this results in the sacrifice of the light-permeable opening area, affects the penetration rate of the panel, and directly increases the cost of the backlight module.

SUMMARY

This disclosure provides a method of driving a display device executed by a computer apparatus to reduce the viewing angle color difference, and improve the penetration rate of the panel and reduce the cost of the backlight module at the same time.

To achieve the above objective, the present disclosure provides a method of driving a display device. The method comprises:

dividing sub-pixels of a display panel into a plurality of array blocks, and selecting at least one of the sub-pixels in each of the array blocks as a luminous pixel;

receiving a to-be-displayed image, acquiring a pixel signal of a pixel of the display panel, obtaining the pixel signal from a look-up table, and obtaining first driving signals of the sub-pixels;

calculating a first brightness signal of driving the luminous pixel in the array block according to the first driving signals of the sub-pixels in each of the array blocks; and using the first brightness signal to drive the luminous pixel, and using the pixel signal to drive other ones of the sub-pixels.

In one embodiment, relative positions between the luminous pixel and other ones of the sub-pixels in each of the array blocks are the same.

In one embodiment, the step of dividing the sub-pixels of the display panel into the a plurality of array blocks, and selecting the at least one of the sub-pixels in the blocks as the luminous pixel comprises:

regarding neighboring two of the sub-pixels as a block, and selecting any one of the sub-pixels in the array block as the one luminous pixel.

In one embodiment, the step of the dividing sub-pixels of the display panel into the a plurality of array blocks, and selecting the at least one of the sub-pixels in the blocks as the luminous pixel comprises:

regarding neighboring four of the sub-pixels as a block, and selecting any one of the sub-pixels in the block as the one luminous pixel.

In one embodiment, the step of the dividing sub-pixels of the display panel into the a plurality of array blocks, and selecting the at least one of the sub-pixels in the blocks as the luminous pixel comprises:

regarding neighboring nine of the sub-pixels as a block, and selecting one of the sub-pixels located at a center of the block as the one luminous pixel.

In one embodiment, the step of calculating the first brightness signal of driving the luminous pixel in the array block according to the first driving signals of the sub-pixels in the same array blocks is performed according to:

$$L=1*L5+0.8*(L2+L4+L6+L8)+0.4*(L1+L3+L7+L9):$$

where L1, L3, L7 and L9 represent the first driving signals of the four sub-pixels at diagonal positions;

L2, L4, L6 and L8 represent the first driving signals of another four sub-pixels neighboring the sub-pixel located at a center position of the block; and L5 represents the first driving signal of the luminous pixel, and L represents the first brightness signal which needs to be calculated.

The present disclosure also provides a device of driving a display device comprising:

a region dividing module dividing sub-pixels of a display panel into a plurality of array blocks, and selecting at least one of the sub-pixels in each of the array blocks as a luminous pixel;

a signal acquiring module receiving a to-be-displayed image, acquiring a pixel signal of the pixel of the display panel, obtaining the pixel signal from a look-up table, and obtaining first driving signals of the sub-pixels of each of the pixels;

a calculating module calculating a first brightness signal of driving the luminous pixel in the array block according to the first driving signals of the sub-pixels in each of the array blocks;

a driving module using the first brightness signal to drive the luminous pixel, and using a pixel signal to drive other ones of the sub-pixels.

In one embodiment, relative positions between the luminous pixel and other ones of the sub-pixels in each of the array blocks are the same.

In one embodiment, the region dividing module regards neighboring two of the sub-pixels as a block, and selects any sub-pixel in the block as the one luminous pixel.

In one embodiment, the region dividing module regards neighboring four of the sub-pixels as a block, and selects any sub-pixel in the block as the one luminous pixel.

In one embodiment, the region dividing module regards neighboring nine of the sub-pixels as a block, and selects one of the sub-pixels located at a center of the block as the one luminous pixel.

In one embodiment, the calculating module calculates the first brightness signal according to:

$$L=1*L5+0.8*(L2+L4+L6+L8)+0.4*(L1+L3+L7+L9).$$

where L1, L3, L7 and L9 represent the first driving signals of the four sub-pixels at diagonal positions;

L2, L4, L6 and L8 represent the first driving signals of another four sub-pixels neighboring the sub-pixel located at a center position of the array block; and L5 represents the first driving signal of the luminous pixel, and L represents the first brightness signal which needs to be calculated.

This disclosure further provides a display device comprising the above-mentioned driving device and driving panel.

In this disclosure, the first pixel of the display panel are divided into a plurality of blocks arranged in an array, wherein at least one luminous pixel for performing the color difference compensation is selected at the same position in each of the blocks. Then, the first driving signals of the sub-pixels are acquired from the received image, wherein the first driving signals are pre-set and can be obtained by searching the look-up table when necessary. The first brightness signal for driving the luminous pixel is calculated according to the first driving signals of the sub-pixels, thereby reducing the viewing-angle color-difference offset, wherein other sub-pixels within the same block are still driven by the pixel signal.

The technical solution of this disclosure does not need to set the primary and secondary pixels on the panel, and thus does not need to design the metal layout and the thin film transistor element to drive the secondary pixel, so that the production processes are simplified and the cost is reduced. At the same time, because the secondary pixel is removed, the penetration rate of the panel is increased.

BRIEF DESCRIPTION OF THE DRAWINGS

The embodiments will become more fully understood from the detailed description and accompanying drawings, which are given for illustration only, and thus are not limitative of the present invention, and wherein:

FIG. 2 is a schematic view showing a first pixel signal distribution when a frame is used to display an image;

FIG. 3 is a schematic view showing a second driving signal distribution when two frames are used to display an image:

FIG. 4 is a schematic view showing a first driving signal distribution when two frames are used to display an image;

FIG. 5 shows a schematic view when luminous pixels set according to blocks adopt the first driving signals in an embodiment:

FIG. 6 shows a schematic view when luminous pixels set according to blocks adopt the first driving signals in another embodiment;

FIG. 7 shows a schematic view when luminous pixels set according to blocks adopt the first driving signals in an embodiment;

FIG. 8 is a schematic view showing relative positions between the luminous pixels at the specific positions and the sub-pixels in the block in an embodiment;

FIG. 9 is a schematic view showing weighting coefficient relations between pixels at the specific positions and pixels at the normal positions in an embodiment;

The examples, features and advantages of this disclosure will be further described in the following embodiments in view of the attached drawings.

DETAILED DESCRIPTION OF THE INVENTION

In order to provide the better understanding of this disclosure to those skilled in the art, the technical solution in the embodiments of this disclosure will be clearly described with reference to the accompanying drawings in the embodiments of this disclosure. Obviously, the described embodiment is the embodiment one portion of the module of this disclosure, rather than the embodiment of the entire module. All other embodiments obtained by those skilled in the art based on the embodiments of this disclosure without making creative work are deemed as falling within the scope of this application.

The specification and claims of this disclosure, and the terms "comprising" in the above-mentioned drawings and any variations thereof intend to cover the non-exclusive inclusion. For example, a process, method, system, product or device comprising a series of steps or units is not limited to the listed steps or units, but may further optionally comprise steps or units not listed, or alternatively comprise other steps or units inherent to these processes, methods, products or equipment. In addition, the terms "first," "second" and "third" are used to distinguish between different objects and not for describing a particular order.

In the description of this disclosure, the terms "first," and "second" are used for the illustrative purpose only and cannot be understood as indicating or implying the relative importance or implicitly specifying the number of indicated technical features. Therefore, the features restricted by "first" and "second" may expressly or implicitly comprise one or multiple ones of the features. In the description of this disclosure, unless otherwise described, the meaning of "multiple" comprises two or more than two. In addition, the terms "comprises" and any modification thereof intend to cover the non-exclusive inclusions.

This disclosure provides a method of driving a display device.

Figure 1:
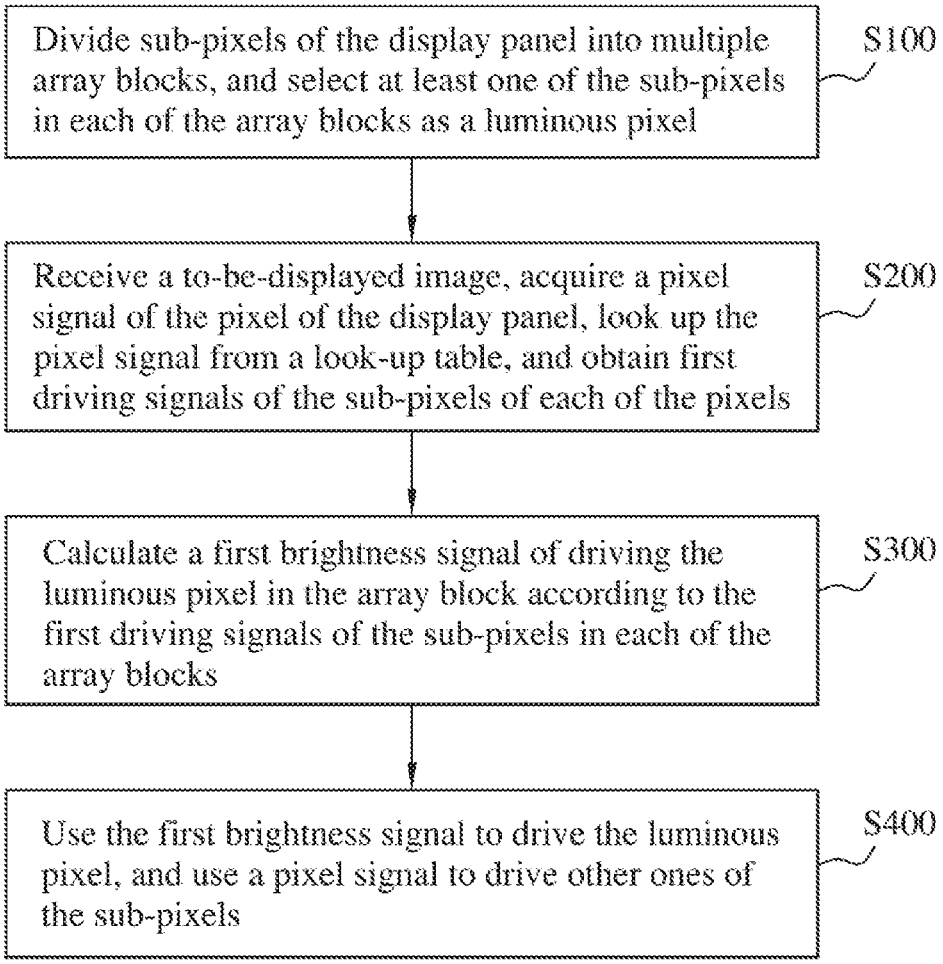
FIG. 1 is a flow chart showing a driving method of a liquid crystal display according to an embodiment of this disclosure.

Referring to FIG. 1, a method of driving a display device in the embodiment of this disclosure includes the following steps.

In a step S100, sub-pixels of the display panel are divided into a plurality of array blocks, and at least one of the sub-pixels in each of the array blocks is selected as a luminous pixel.

In a step S200, a to-be-displayed image is received, a pixel signal of a pixel of the display panel is acquired, the pixel signal is obtained from a look-up table, and first driving signals of the sub-pixels of each of the pixels are obtained. In this embodiment, every pixel may include, for example, three sub-pixels, that is. R, G and B pixels (referred to as RGB pixels). In this embodiment, the sub-pixel can be any of the RGB pixels. However, this disclosure is not limited thereto, and the sub-pixel of each of the pixels may also be the combination of other color pixels, for example, the combination of two pixels of RG, GB or RB.

It is to be described that the pixel signal includes a first driving signal and a second driving signal. In this embodiment, the first driving signal is a low voltage driving signal, and the second driving signal is a high voltage driving signal.

In a step S300, a first brightness signal of driving the luminous pixel in the array block is calculated according to the first driving signals of the sub-pixels in each of the array blocks.

In a step S400, the first brightness signal is used to drive the luminous pixel, and a pixel signal is used to drive other ones of the sub-pixels.

It is to be described that in the embodiment of this disclosure, the driving method is applied to the liquid crystal display, and the driving signal of the display panel is alternately driven in order by the high and low voltage signals with an image frame in the existing technology.

FIG. 2 shows that an image is displayed using a frame, where R represents that the pixel signal is used to drive the corresponding sub-pixel.

FIGS. 3 and 4 represent that two frames are used to display an image. In FIG. 3, H represents that the second driving signal is used to drive the corresponding sub-pixel. In FIG. 4, L represents that the first driving signal is used to drive the corresponding sub-pixel.

The second driving signal RH/GH/BH and the first driving signal RL/GL/BL are predetermined high and low voltage driving signals given in advance according to the RGB input signals, and are determined according to the viewing angle effect which need to be compensated, and related data has been written to the liquid crystal display upon the production of the liquid crystal display. Typically, the data is recorded into the hardware buffer in the format of a look-up table (LUT). Taking an 8-bit driving signal as an example, each R/G/B input signal has inputs 0 to 255 corresponding to 256 high and low voltage signals in total, and there are 3*256 pairs of high voltage signals RH/GH/BH and low voltage signal RL/GL/BL.

In the liquid crystal display, the display effect of the liquid crystal is determined by the common driving of the first driving signal, the second driving signal and the brightness signal of the backlight source. In this embodiment, the brightness signal of the backlight source does not change, and only the driving signal of the panel is adjusted.

In this disclosure, the first pixel of the display panel are divided into a plurality of blocks arranged in an array, wherein at least one luminous pixel for performing the color difference compensation is selected at the same position in each of the blocks. Then, the first driving signals of the first pixels are acquired from the received image, wherein the first driving signals are pre-set and can be obtained by searching the look-up table when necessary. The first brightness signal for driving the luminous pixel is calculated according to the first driving signals of the sub-pixels, thereby reducing the viewing-angle color-difference offset, wherein other sub-pixels within the same block are still driven by the pixel signal. The technical solution of this disclosure does not need to set the primary and secondary pixels on the panel, and thus does not need to design the metal layout and the thin film transistor element to drive the secondary pixel, so that the production processes are simplified and the cost is reduced. At the same time, because the secondary pixel is removed, the penetration rate of the panel is increased.

In this embodiment, relative positions between the luminous pixel and other ones of the sub-pixels in each of the array blocks are the same.

According to the number of sub-pixels in an array block, there are several embodiments provided in the following.

Referring to FIG. 5, in one embodiment, the step of dividing the sub-pixels of the display panel into the a plurality of array blocks, and selecting the at least one of the sub-pixels in the blocks as the one luminous pixel includes:

regarding neighboring two of the sub-pixels as a block, and selecting any one of the sub-pixels in the block as the one luminous pixel.

In FIG. 5, L represents that the first driving signal is used, and R represents that the pixel signal is used to drive directly. In the embodiment of this disclosure. L and R are used at the same time to drive the sub-pixel of the display panel, and a frame is used to display an image.

Here, neighboring two of the sub-pixels are regarded as a block in a horizontal direction, and the entire display panel can be divided into several block arrays. The sub-pixels at the same position in all blocks are selected as the luminous pixels. The first brightness signal of the luminous pixel is calculated according to the first driving signals of the two sub-pixels. Then, the first brightness signal and the pixel signal are respectively used to drive two types of pixels.

In another embodiment, the step of dividing the sub-pixels of the display panel into the a plurality of array blocks, and selecting the at least one of the sub-pixels in the blocks as the one luminous pixel includes:

regarding neighboring four of the sub-pixels as a block, and selecting any one of the sub-pixels in the block as the one luminous pixel.

In FIG. 6, L represents that the first driving signal is used, and R represents that the pixel signal is used to drive directly. In the embodiment of this disclosure, L and R are used at the same time to drive the sub-pixel of the display panel, and a frame is used to display an image.

Here, neighboring four of the first pixels are regarded as a block, and the four first pixels are located at four vertices of a square. The sub-pixels at the same position in all blocks are selected as the luminous pixels. The first brightness signal of the luminous pixel is calculated according to the first driving signal of the four sub-pixels. Then, the first brightness signal and the pixel signal are respectively used to drive two types of pixels.

In yet another embodiment, the step of dividing the sub-pixels of the display panel into the a plurality of array blocks, and selecting the at least one of the sub-pixels in the blocks as the one luminous pixel includes:

regarding neighboring nine of the sub-pixels as a block, and selecting any one of the sub-pixels in the block as the one luminous pixel.

In FIG. 7, L represents that the first driving signal is used, and R represents that the pixel signal is used to drive directly. In the embodiment of this disclosure, L and R are used at the same time to drive the sub-pixel of the display panel, and a frame is used to display an image.

Here, neighboring nine of the first pixels are regarded as a block, and the nine first pixels are located at four vertices of a square. The sub-pixels at the same position in all blocks are selected as the luminous pixels. The first brightness signal of the luminous pixel is calculated according to the first driving signal of the nine sub-pixels. Then, the first brightness signal and the pixel signal are respectively used to drive two types of pixels.

In this embodiment, the step of calculating the first brightness signal of driving the luminous pixel in the array block according to the first driving signals of the non-luminous pixels in the same array blocks is performed according to:

$$L=1*L5+0.8*(L2+L4+L6+L8)+0.4*(L1+L3+L7+L9);$$

where L1, L3, L7 and L9 represent the first driving signals of the four sub-pixels at diagonal positions;

L2, L4, L6 and L8 represent the first driving signals of another four sub-pixels neighboring the sub-pixel located at a center position of the array block; and L5 represents the first driving signal of the luminous pixel, and L represents the first brightness signal which needs to be calculated.

Please refer to FIGS. 8 and 9. FIG. 8 shows the relative positions between L1 to L9 in a block. FIG. 9 shows weighting coefficient relations between all the sub-pixels in the same block and the luminous pixel.

It is to be described that the first brightness signal is calculated by counting and adjusting the weighting coefficients according to that all the sub-pixels in the unit in theory need to be given with the low voltage signal compensation and the influence of the true position of the corresponding position of the individual sub-elements in the unit, so that the compensation effect of the low brightness sub-pixel signal can satisfy the effect that the signals of the unit to be compensated in average. The adjustment of the weighting coefficient also responds with the sub-pixel gray scale signal to be provided to the true corresponding image at the position of the sub-pixel.

In the example where nine sub-pixels are regarded as one unit, the weighting coefficient at the position of displaying the first brightness signal is replaced with 1, and this represents that the actual influence at the position reaches the maximum. The first brightness signals at top, bottom, left and right positions are given with a sub-weighting coefficient of 0.8, and the first brightness signals at four corners are given with a sub-weighting coefficient of 0.4. This can truly respond the true representative signal, which should be responded at the position of the display low gray scale, and also can provide the reasonable brightness distribution for the surrounding sub-pixels.

The technical solution of this disclosure is to solve the drawbacks of the viewing angle color shift of the TN, OCB and VA type TFT display panels. The bottom-lighting or lateral side backlight, white light or RGB three-color light source is used in conjunction with the first driving signal and the second driving signal of the panel to compensate and adjust the backlight brightness to reduce the flicker phenomenon caused by the switching differences of the high and low voltage driving signals of the panel. Meanwhile, the advantage of compensating the viewing angle color shift using the high and low liquid crystal voltages still can be kept. Second, the pixel is no longer designed to be a primary pixel and a secondary pixel, and this greatly enhances the penetration rate of the TFT display panel, and reduces the cost of backlight design. For the high-resolution TFT display panel development, the pixel is no longer designed to be a primary pixel and a secondary pixel, and the effects of the improved penetration rate and the enhanced resolution become more significant.

In some embodiments, the display device of this disclosure may be a liquid crystal display device, an OLED display device or other display devices, which may include a liquid crystal television, a computer liquid crystal display, a notebook computer and the like.

Figure 10:
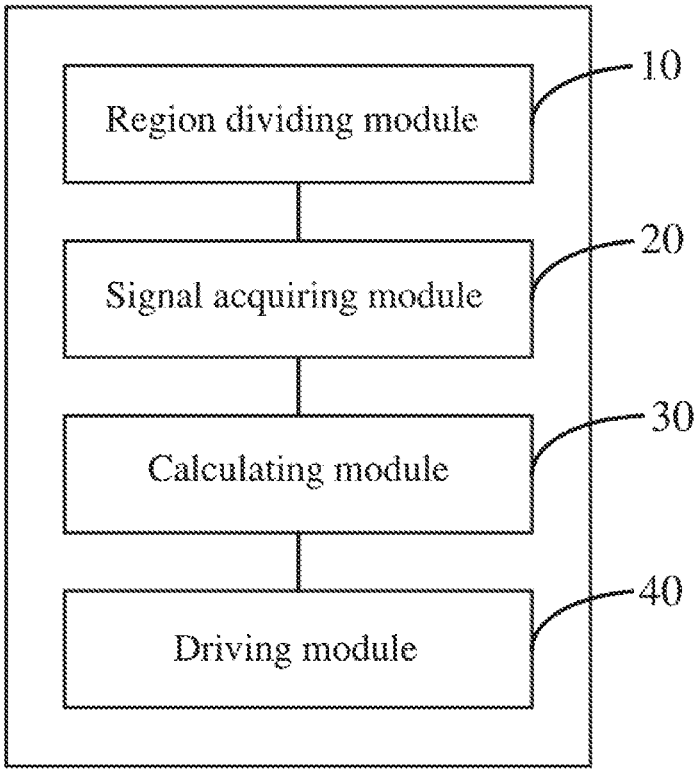
FIG. 10 is a functional module diagram showing a driving device of a display device according to an embodiment of this disclosure.

Referring to FIG. 10, the disclosure further provides a driving device of a liquid crystal display device based on the above-mentioned driving method of a liquid crystal display device, which includes:

a region dividing module 10 dividing sub-pixels of a display panel into a plurality of array blocks, and selecting at least one of the sub-pixels in each of the array blocks as a luminous pixel;

a signal acquiring module 20 receiving a to-be-displayed image, acquiring a pixel signal of the pixel of the display panel, obtaining the pixel signal from a look-up table, and obtaining first driving signals of the sub-pixels of each of the pixels;

a calculating module 30 calculating a first brightness signal of driving the luminous pixel in the array block according to the first driving signals of the sub-pixels in each of the array blocks;

a driving module 40 using the first brightness signal to drive the luminous pixel, and using a pixel signal to drive other ones of the sub-pixels.

In an embodiment, a region dividing module 10 regards neighboring four of the sub-pixels as a block, and selects any sub-pixel in the block as a luminous pixel.

In one embodiment, the region dividing module 10 regards neighboring four of the sub-pixels as a block, and selects any sub-pixel in the block as the one luminous pixel.

In one embodiment, the region dividing module 10 regards neighboring nine of the sub-pixels as a block, and selects one of the sub-pixels located at a center of the block as the one luminous pixel.

In one embodiment, the calculating module calculates the first brightness signal according to:

$$L=l*L5+0.8*(L2+L4+L6+L8)+0.4*(L1+L3+L7+L9).$$

where L1, L3, L7 and L9 represent the first driving signals of the four sub-pixels at diagonal positions;

L2, L4, L6 and L8 represent the first driving signals of another four sub-pixels neighboring the sub-pixel located at a center position of the array block;

L5 represents the first driving signal of the luminous pixel, and L represents the first brightness signal which needs to be calculated.

Figure 11:
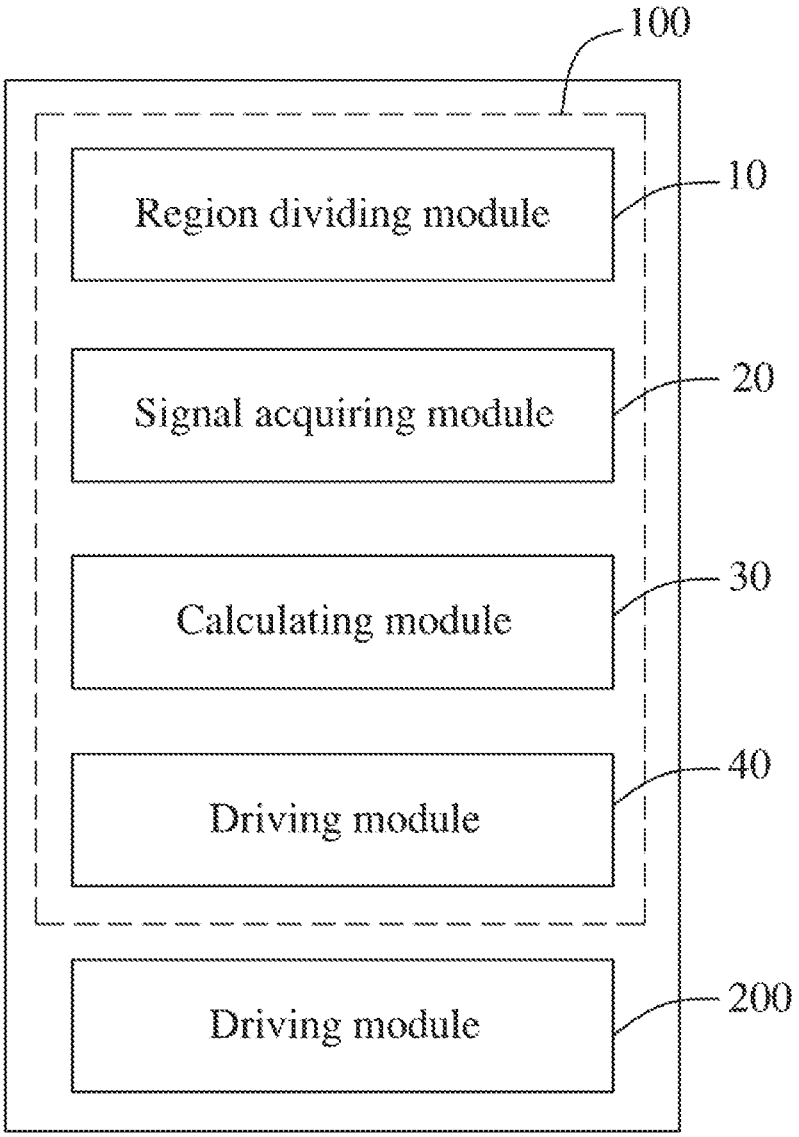
FIG. 11 is a functional module diagram showing a display device according to an embodiment of this disclosure.

Referring to FIG. 11, this disclosure further provides a display device, the display device includes a driving device 100 for the above-mentioned display device, and a display panel 200, and the specific structure of the driving device of the display device can be found in the above-mentioned embodiment. The display device adopts all the technical solutions of all of the above-mentioned embodiments, and thus has at least all of the useful effects brought by the technical solutions of the above-mentioned embodiments, so that detailed descriptions thereof will be omitted.

The display device may be a tablet computer display screen, a television display screen, a computer display screen or the like.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A method of driving a display device, comprising:

dividing sub-pixels of a display panel into a plurality of array blocks, and selecting at least one of the sub-pixels in each of the array blocks as a luminous pixel;

receiving a to-be-displayed image, acquiring a pixel signal of a pixel of the display panel, obtaining the pixel signal from a look-up table, and obtaining first driving signals of the sub-pixels;

calculating a first brightness signal of driving the luminous pixel in the array block according to the first driving signals of the sub-pixels in each of the array blocks; and using the first brightness signal to drive the luminous pixel, and using the pixel signal to drive other ones of the sub-pixels, wherein the step of calculating the first brightness signal of driving the luminous pixel in the array block according to the first driving signals of the sub-pixels in the same array blocks is performed according to:

$$L=1*L5+0.8*(L2+L4+L6+L8)+0.4*(L1+L3+L7+L9);$$

where L1, L3, L7 and L9 represent the first driving signals of the four sub-pixels at diagonal positions;

L2, L4, L6 and L8 represent the first driving signals of another four sub-pixels neighboring the sub-pixel located at a center position of the array block; and L5 represents the first driving signal of the luminous pixel, and L represents the first brightness signal which needs to be calculated.

2. The method of driving the display device according to claim 1, wherein relative positions between the luminous pixel and other ones of the sub-pixels in each of the array blocks are the same.

3. The method of driving the display device according to claim 2, wherein the step of the dividing sub-pixels of the display panel into the plurality of array blocks, and selecting the at least one of the sub-pixels in the blocks as the luminous pixel comprises:

regarding neighboring four of the sub-pixels as a block, and selecting any one of the sub-pixels in the block as the one luminous pixel.

4. The method of driving the display device according to claim 2, wherein the step of the dividing sub-pixels of the display panel into the plurality of array blocks, and selecting the at least one of the sub-pixels in the blocks as the luminous pixel comprises:

regarding neighboring nine of the sub-pixels as a block, and selecting one of the sub-pixels located at a center of the block as the one luminous pixel.

5. The method of driving the display device according to claim 1, wherein the step of dividing the sub-pixels of the display panel into the plurality of array blocks, and selecting the at least one of the sub-pixels in the blocks as the luminous pixel comprises:

regarding neighboring four of the sub-pixels as a block, and selecting any one of the sub-pixels in the block as the one luminous pixel.

6. The method of driving the display device according to claim 1, wherein the step of the dividing sub-pixels of the display panel into the plurality of array blocks, and selecting the at least one of the sub-pixels in the blocks as the luminous pixel comprises:

regarding neighboring nine of the sub-pixels as a block, and selecting one of the sub-pixels located at a center of the block as the one luminous pixel.

7. A driving device of a display device, comprising:

a region dividing module dividing sub-pixels of a display panel into a plurality of array blocks, and selecting at least one of the sub-pixels in each of the array blocks as a luminous pixel;

a signal acquiring module receiving a to-be-displayed image, acquiring a pixel signal of the pixel of the display panel, obtaining the pixel signal from a look-up table, and obtaining first driving signals of the sub-pixels of each of the pixels;

a calculating module calculating a first brightness signal of driving the luminous pixel in the array block according to the first driving signals of the sub-pixels in each of the array blocks; and a driving module using the first brightness signal to drive the luminous pixel, and using a pixel signal to drive other ones of the sub-pixels, wherein the calculating module calculates the first brightness signal according to:

$$L=1*L5+0.8*(L2+L4+L6+L8)+0.4*(L1+L3+L7+L9);$$

where L1, L3, L7 and L9 represent the first driving signals of the four sub-pixels at diagonal positions;

L2, L4, L6 and L8 represent the first driving signals of another four sub-pixels neighboring the sub-pixel located at a center position of the block; and L5 represents the first driving signal of the luminous pixel, and L represents the first brightness signal which needs to be calculated.

8. The driving device of the display device according to claim 7, wherein relative positions between the luminous pixel and other ones of the sub-pixels in each of the array blocks are the same.

9. The driving device of the display device according to claim 8, wherein the region dividing module regards neighboring nine of the sub-pixels as a block, and selects one of the sub-pixels located at a center of the block as the one luminous pixel.

10. The driving device of the display device according to claim 7, wherein the region dividing module regards neighboring four of the sub-pixels as a block, and selects any sub-pixel in the block as the one luminous pixel.

11. The driving device of the display device according to claim 7, wherein the region dividing module regards neighboring nine of the sub-pixels as a block, and selects one of the sub-pixels located at a center of the array block as the one luminous pixel.

12. A display device, comprising: a display panel; a driving part; and a driving device, wherein the driving device comprising:

a region dividing module dividing sub-pixels of the display panel into a plurality of array blocks, and selecting at least one of the sub-pixels in each of the array blocks as a luminous pixel, a signal acquiring module receiving a to-be-displayed image, acquiring a pixel signal of the pixel of the display panel, obtaining the pixel signal from a look-up table, and obtaining first driving signals of the sub-pixels of each of the pixels, a calculating module calculating a first brightness signal of driving the luminous pixel in the array block according to the first driving signals of the sub-pixels in each of the array blocks, and a driving module using the first brightness signal to drive the luminous pixel, and using a pixel signal to drive other ones of the sub-pixels, wherein the calculating module calculates the first brightness signal according to:

$$L=1*L5+0.8*(L2+L4+L6+L8)+0.4*(L1+L3+L7+L9);$$

where L1, L3, L7 and L9 represent the first driving signals of the four sub-pixels at diagonal positions;

L2, L4, L6 and L8 represent the first driving signals of another four sub-pixels neighboring the sub-pixel located at a center position of the block; and L5 represents the first driving signal of the luminous pixel, and L represents the first brightness signal which needs to be calculated.

* * * * *